US008596768B2

(12) United States Patent
Koike et al.

(10) Patent No.: US 8,596,768 B2
(45) Date of Patent: Dec. 3, 2013

(54) LIQUID DISCHARGING APPARATUS AND CONTROL METHOD THEREOF

(75) Inventors: Kaoru Koike, Matsumoto (JP); Toshio Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/410,498

(22) Filed: Mar. 2, 2012

(65) Prior Publication Data

US 2012/0224007 A1 Sep. 6, 2012

(30) Foreign Application Priority Data

Mar. 4, 2011 (JP) ..... 2011-047524

(51) Int. Cl.
*B41J 2/175* (2006.01)
*B41J 2/19* (2006.01)

(52) U.S. Cl.
USPC ..... 347/85; 347/92

(58) Field of Classification Search
USPC ..... 347/84, 85, 92, 93
See application file for complete search history.

(56) References Cited

U.S. PATENT DOCUMENTS

| | | | | |
|---|---|---|---|---|
| 6,007,193 | A | 12/1999 | Kashimura et al. | |
| 6,082,851 | A * | 7/2000 | Shihoh et al. | 347/85 |
| 6,217,164 | B1 * | 4/2001 | Hino | 347/85 |
| 6,231,174 | B1 * | 5/2001 | Haigo | 347/89 |
| 6,663,233 | B2 * | 12/2003 | Otsuka et al. | 347/85 |
| 6,948,803 | B2 * | 9/2005 | Yoshida et al. | 347/85 |
| 7,841,706 | B2 * | 11/2010 | Ishinaga et al. | 347/84 |
| 8,141,981 | B2 * | 3/2012 | Obertegger et al. | 347/36 |
| 8,205,973 | B2 * | 6/2012 | Nitta et al. | 347/85 |
| 8,292,420 | B2 * | 10/2012 | Weingartner et al. | 347/104 |
| 8,403,467 | B2 * | 3/2013 | Asami | 347/85 |
| 8,408,685 | B2 * | 4/2013 | Delueg | 347/85 |
| 2004/0090501 | A1 * | 5/2004 | Yoshida et al. | 347/85 |
| 2005/0116999 | A1 | 6/2005 | Ando et al. | |
| 2006/0209140 | A1 * | 9/2006 | Nagai | 347/85 |
| 2008/0024553 | A1 * | 1/2008 | Morgan et al. | 347/42 |
| 2008/0158307 | A1 * | 7/2008 | Nitta et al. | 347/85 |
| 2008/0239013 | A1 | 10/2008 | Hirashima | |
| 2009/0009569 | A1 * | 1/2009 | Sasaki | 347/85 |
| 2009/0046132 | A1 * | 2/2009 | Izawa et al. | 347/85 |
| 2009/0213157 | A1 * | 8/2009 | Obertegger et al. | 347/14 |
| 2010/0026739 | A1 * | 2/2010 | Hirashima | 347/6 |
| 2010/0039460 | A1 * | 2/2010 | Delueg | 347/7 |
| 2010/0110155 | A1 * | 5/2010 | Delueg | 347/93 |
| 2010/0245495 | A1 * | 9/2010 | Katada et al. | 347/85 |

(Continued)

FOREIGN PATENT DOCUMENTS

| | | |
|---|---|---|
| JP | 10-029317 | 2/1998 |
| JP | 10-230623 | 9/1998 |
| JP | 11-198403 | 7/1999 |
| JP | 11-342634 | 12/1999 |
| JP | 2000-033714 | 2/2000 |
| JP | 2005-125667 | 5/2005 |
| JP | 2006-247899 | 9/2006 |
| JP | 2008-246843 | 10/2008 |
| JP | 4270300 | 3/2009 |
| JP | 4337500 | 7/2009 |
| JP | 2011-051171 | 3/2011 |
| JP | 2012-000883 A | 1/2012 |
| JP | 2012-883 A | 1/2012 |

*Primary Examiner* — Matthew Luu
*Assistant Examiner* — Patrick King
(74) *Attorney, Agent, or Firm* — Workman Nydegger

(57) ABSTRACT

When a printing head is filled with an ink, a circulating pump is controlled so that an ink equal to or greater than the entire volume of a circulating path circulates from a feeding path hole to a returning path hole via a printing head (in a forward direction), and after that, the circulating pump is controlled so that the ink equal to or greater than the entire volume of the circulating path circulates from the returning path hole to the feeding path hole via the printing head (in a reverse direction). By doing so, gas (bubbles) in the circulating path may be more securely discharged to a sub tank.

7 Claims, 6 Drawing Sheets

(56) References Cited

U.S. PATENT DOCUMENTS

2010/0245496 A1* 9/2010 Yokota ..... 347/85
2011/0007105 A1* 1/2011 Kuribayashi et al. ..... 347/6
2011/0050794 A1 3/2011 Koike et al.
2011/0063381 A1* 3/2011 Nitta et al. ..... 347/85
2011/0279570 A1* 11/2011 Borra et al. ..... 347/85

* cited by examiner

LIQUID DISCHARGING APPARATUS AND CONTROL METHOD THEREOF

BACKGROUND

1. Technical Field

The present invention relates to a liquid discharging apparatus and a control method thereof.

2. Related Art

Heretofore, as such a kind of liquid discharging apparatus, an apparatus has been proposed including a printing head for ejecting ink, an ink tank accommodating the ink, a first ink channel for supplying the ink from the ink tank to a manifold of the printing head, a second ink channel for retrieving the ink from the manifold to the ink tank, an ink circulating pump installed at the first ink channel, an opening/closing valve installed at the second ink channel, a suction cap for covering nozzle surface of the printing head, and a suction pump connected to the suction cap via a suction pipe, wherein, when the ink is filled in the printing head, the nozzle surface of the printing head is covered by the suction cap and the opening/closing valve opens to rotatably drive the ink circulating pump, so that the ink circulates through a circulating channel composed of the first ink channel, the manifold, and the second ink channel (for example, see JP-A-2000-33714). In this apparatus, when the ink circulates through the circulating channel in order to fill the printing head with the ink, the rotation direction of the ink circulating pump is reversed only for a short time, which easily removes bubbles in the circulating channel and restrains a back flow of ink or bubbles in the circulating channel.

In the above liquid discharging apparatus, it is possible to prevent ink or bubbles from flowing backward, but in the case where the circulating channel has a location at which bubbles tend to stay (for example, a joint of each component of the circulating channel) when ink flows in a forward direction, the bubbles in the circulating channel may not be sufficiently removed.

SUMMARY

An advantage of some aspects of the invention is to provide a liquid discharging apparatus and the control method thereof, which may more securely remove gas (bubbles) in a circulating path when liquid is filled in a discharging head.

The liquid discharging apparatus and the control method thereof take the following units in this aspect.

In one aspect, the present invention provides a liquid discharging apparatus having a discharging head with a plurality of nozzles for discharging a liquid, which includes a storing unit for storing a liquid; a circulating path configured to include the discharging head so that one opening end portion and the other opening end portion are disposed in the storing unit; a pump unit installed at the one opening end portion side rather than the discharging head in the circulating path and capable of pumping a liquid so that the liquid circulates along the circulating path; and a charge time control unit for executing a first circulation control which controls the pump unit so that an amount of liquid equal to or greater than an entire volume of the circulating path circulates from the one opening end portion side to the other opening end portion side via the discharging head by the drive of the pump unit when the discharging head is filled with the liquid, and after the first circulation control is executed, and for executing a second circulation control which controls the pump unit so that the amount of liquid equal to or greater than the entire volume of the circulating path circulates from the other opening end portion side to the one opening end portion side via the discharging head by the drive of the pump unit.

In the liquid discharging apparatus of the present invention, when the discharging head is filled with a liquid, the first circulation control for controlling the pump unit so that an amount of liquid equal to or greater than the entire volume of the circulating path circulates from the one opening end portion side to the other opening end portion side via the discharging head (hereinafter, referred to as circulation in a forward direction) by the drive of the pump unit is executed, and after the first circulation control is executed, the second circulation control for controlling the pump unit so that the amount of liquid equal to or greater than the entire volume of the circulating path circulates from the other opening end portion side to the one opening end portion side via the discharging head (hereinafter, referred to as circulation in a reverse direction) by the drive of the pump unit is executed. Therefore, since the amount of liquid equal to or greater than the entire volume of the circulating path circulates along the circulating path in the forward direction and then the amount of liquid equal to or greater than the entire volume of the circulating path circulates along the circulating path in the reverse direction, even though the circulating path has a location where gas (bubbles) may easily stay when the liquid circulates along the circulating path in the forward direction, the liquid of the circulating path may be more securely removed.

The liquid discharging apparatus according to the present invention may further include an opening/closing valve installed at the other opening end portion side rather than the discharging head in the circulating path so as to be capable of opening/closing, and the charge time control unit may execute the first circulation control in a state where the opening/closing valve is open, then control the opening/closing valve so that the opening/closing valve is closed, control the pump unit so that a predetermined liquid which is at the one opening end portion side rather than the opening/closing valve in the circulating path is pumped to the one opening end portion side by the drive of the pump unit, control the opening/closing valve so that the opening/closing valve is opened, and then execute the second circulation control. By doing so, in the case where gas is present in the circulating path, it is possible to expand the gas (bubbles) in the circulating path by lowering the pressure at the predetermined portion, and the flow rate may be increased after the opening/closing valve is opened, so that the gas may be easily discharged to the storing unit. In the liquid discharging apparatus according to the present invention, after the first circulation control is executed and the one opening/closing valve is opened, the charge time control unit may execute a short-time first control for controlling the pump unit so that the liquid is pumped from the other opening end portion side to the one opening end portion side during a shorter time than the execution time of the second circulation control by the drive of the pump unit, and a short-time second control for controlling the pump unit so that the liquid is pumped from the one opening end portion side to the other opening end portion side by the drive of the pump unit during a shorter time than the execution time of the second circulation control after the short-time first control is executed, predetermined times, and then execute the second circulation control. By doing so, in the case where gas is present in the circulating path, the gas may be easily discharged to the storing unit by moving the gas to the one opening end portion side or the other opening end portion side.

In addition, in the liquid discharging apparatus according to the present invention, after the first circulation control is executed, the charge time control unit may execute a short-time first control for controlling the pump unit so that the liquid is pumped from the other opening end portion side to the one opening end portion side by the drive of the pump unit during a shorter time than the execution time of the second circulation control, and a short-time second control for controlling the pump unit so that the liquid is pumped from the one opening end portion side to the other opening end portion side by the drive of the pump unit during a shorter time than the execution time of the second circulation control after the short-time first control is executed, predetermined times, and then execute the second circulation control. By doing so, in the case where gas is present in the circulating path, the gas may be easily discharged to the storing unit by moving the gas to the one opening end portion side or the other opening end portion side.

Further the liquid discharging apparatus according to the present invention may further include a height adjustment unit capable of adjusting the height of at least one of the one opening end portion and the other opening end portion in the circulating path in a gravity direction, and the charge time control unit may control the height adjustment unit so that the one opening end portion is lower than the other opening end portion when the liquid circulates from the one opening end portion side to the other opening end portion side, and the charge time control unit may control the height adjustment unit so that the other opening end portion is lower than the one opening end portion when the liquid circulates from the other opening end portion side to the one opening end portion side. By doing so, it is possible to restrain gas from penetrating from the storing unit to the circulating path.

Moreover, in the liquid discharging apparatus according to the present invention, the circulating path may be formed so that the one opening end portion and the other opening end portion have the same height in a gravity direction.

In addition, the liquid discharging apparatus according to the present invention may further include a sealing unit capable of sealing each of the plurality of nozzles independently, and the charge time control unit may execute at least the first circulation control and the second circulation control in a state where the plurality of nozzles are respectively sealed by the sealing unit independently. By doing so, it is possible to restrain liquid from discharging (leaking) from the nozzles when the first circulation control or second circulation control is executed. The liquid discharging apparatus according to the present invention may further include a compressing unit capable of compressing the storing unit, and after the second circulation control is executed, the charge time control unit may execute a sealing release control for controlling the compressing unit and the sealing unit so that the sealing of the plurality of nozzles by the sealing unit is released as the storing unit is compressed by the compressing unit. In addition, in the liquid discharging apparatus according to the present invention, after the second circulation control is executed, the charge time control unit may execute a sealing release control for controlling the pump unit and the sealing unit so that the sealing of the plurality of nozzles by the sealing unit is released as the liquid circulates along the circulating path by the drive of the pump unit. By doing so, gas in the nozzles may be discharged by executing the sealing release control.

In another aspect, the present invention also provides a control method of a liquid discharging apparatus, which includes a discharging head having a plurality of nozzles for discharging a liquid, a storing unit for storing the liquid, a circulating path configured to include the discharging head so that one opening end portion and the other opening end portion are disposed in the storing unit, and a pump unit installed at the one opening end portion side rather than the discharging head in the circulating path and capable of pumping a liquid so that the liquid circulates along the circulating path, wherein the method includes: executing a first circulation control which controls the pump unit so that an amount of liquid equal to or greater than the entire volume of the circulating path circulates from the one opening end portion side to the other opening end portion side via the discharging head by the drive of the pump unit when the discharging head is filled with the liquid; and after the first circulation control is executed, executing a second circulation control which controls the pump unit so that the amount of liquid equal to or greater than the entire volume of the circulating path circulates from the other opening end portion side to the one opening end portion side via the discharging head by the drive of the pump unit.

In the control method of a liquid discharging apparatus according to the present invention, when the discharging head is filled with a liquid, the first circulation control for controlling the pump unit so that an amount of liquid equal to or greater than the entire volume of the circulating path circulates from the one opening end portion side to the other opening end portion side via the discharging head (hereinafter, referred to as circulation in a forward direction) by the drive of the pump unit is executed, and after the first circulation control is executed, the second circulation control for controlling the pump unit so that the amount of liquid equal to or greater than the entire volume of the circulating path circulates from the other opening end portion side to the one opening end portion side via the discharging head (hereinafter, referred to as circulation in a reverse direction) by the drive of the pump unit is executed. Therefore, since the amount of liquid equal to or greater than the entire volume of the circulating path circulates along the circulating path in the forward direction and then the amount of liquid equal to or greater than the entire volume of the circulating path circulates along the circulating path in the reverse direction, even though the circulating path has a location where gas (bubbles) may easily stay when the liquid circulates along the circulating path in the forward direction, the liquid of the circulating path may be more securely removed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
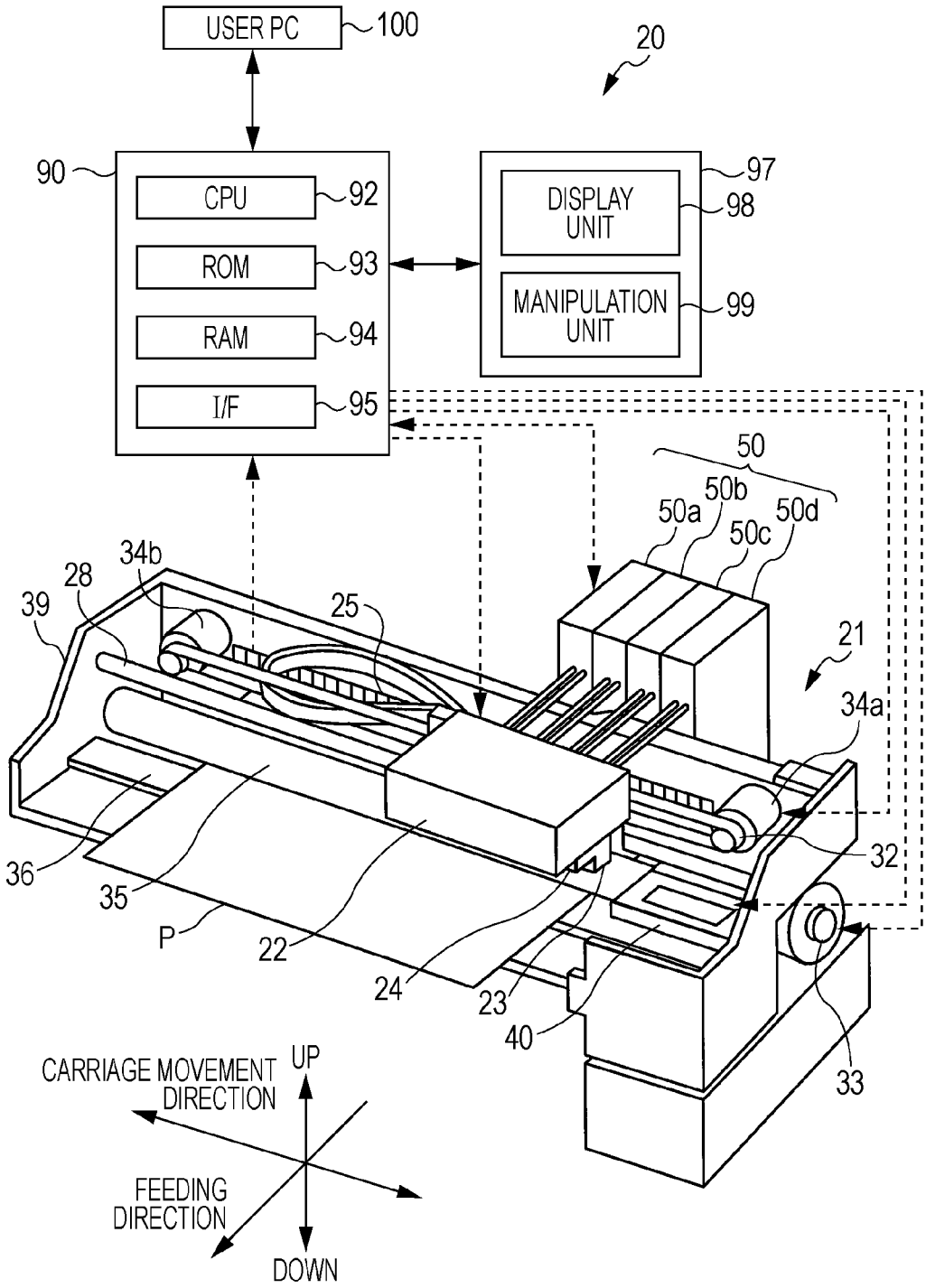
FIG. 1 is a diagram schematically showing the configuration of an ink jet printer.
Figure 2:
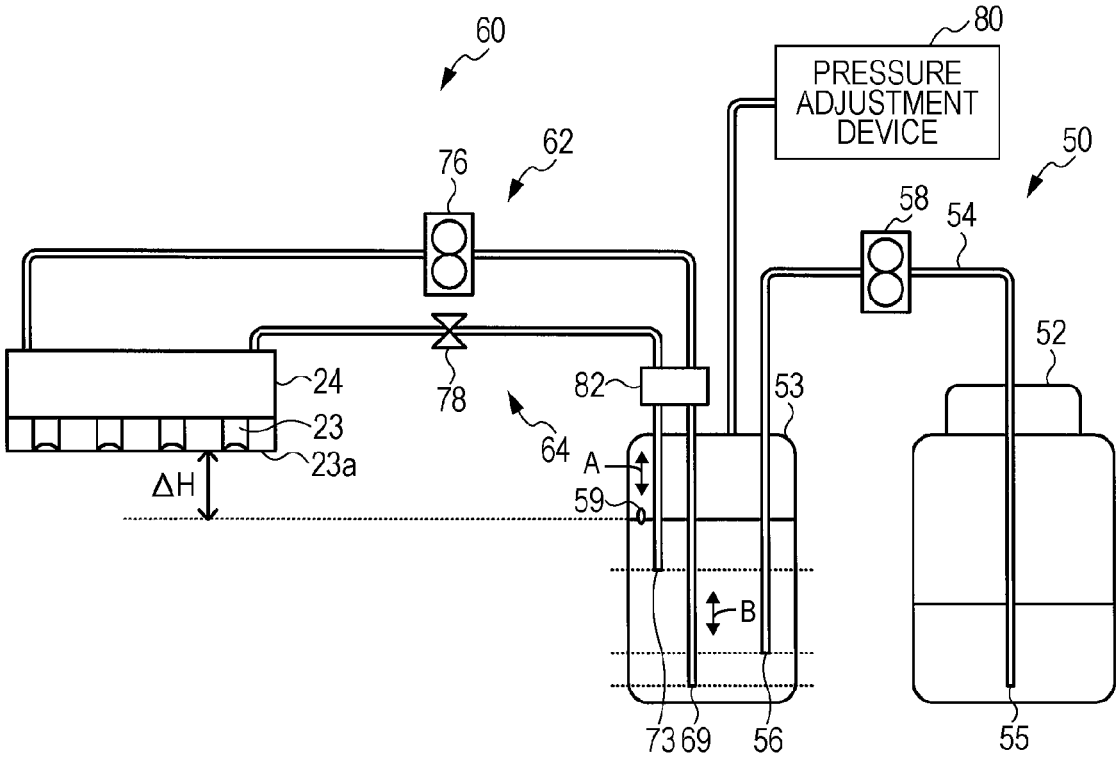
FIG. 2 is a diagram schematically showing the configuration of an ink circulating system.
Figure 3:
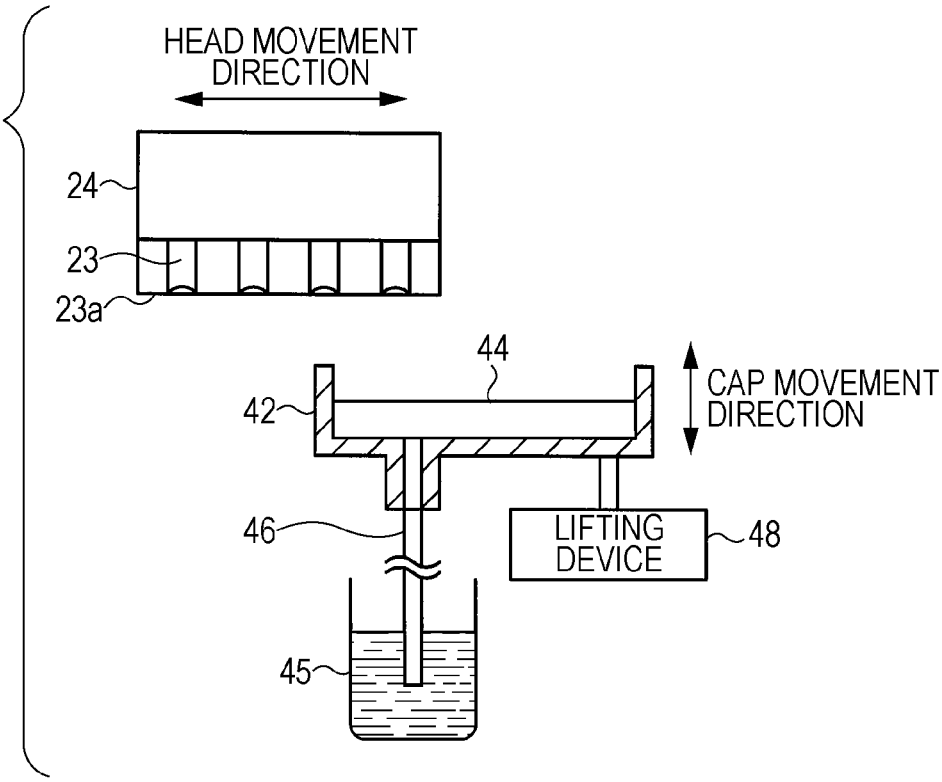
FIG. 3 is a diagram schematically showing the configuration of a capping device.

Next, an embodiment of the present invention will be described with reference to the drawings. FIG. 1 is a diagram schematically showing the configuration of an ink jet printer 20. FIG. 2 is a diagram schematically showing the configuration of an ink circulating system 50. FIG. 3 is a diagram schematically showing the configuration of a capping device 40.

The ink jet printer 20 of this embodiment includes, as shown in FIG. 1, a printer mechanism 21 for sending ink droplets from a plurality of nozzles 23 formed at a printing head 24 to a paper P fed on a platen 36 to perform printing, a capping device 40 disposed near the right end of the platen 36 and capable of independently sealing the plurality of nozzles 23 of the printing head 24, a controller 90 for controlling the entire apparatus, and a manipulation panel 97 having a display unit 98 for notifying various kinds of information to a user or a manipulation unit 99 allowing a user to input various instructions.

The printer mechanism 21 includes a paper feeding roller 35 driven by a drive motor 33 to feed the paper P from the inner side in the figure to a front side on the platen 36, a carriage 22 mounted to a carriage belt 32 to reciprocate along the guide 28 in the right and left direction (the main scanning direction), a linear-type encoder 25 for detecting the location of the carriage 22, a printing head 24 installed at the lower portion of the carriage 22 and having the plurality of nozzles 23, and ink circulating systems 50*a* to 50*d* (hereinafter, also generally referred to as an ink circulating system 50) for respectively circulating cyan (C), magenta (M), yellow (Y), and black (K) inks via the printing head 24. Here, the carriage 22 is mounted to the carriage belt 32 installed between a carriage motor 34*a* mounted at the right side of a mechanical frame 39 and a driven roller 34*b* mounted at the left side of the mechanical frame 39 to reciprocate along the guide 46 in the right and left direction as the carriage belt 32 is driven by the carriage motor 34*a*. In addition, the printing head 24 may be operated to deform a piezoelectric element to compress an ink by applying a voltage to the piezoelectric element included therein, or may be operated to compress an ink by means of bubbles generated by heating the ink by applying a voltage to a heating resistor (for example, a heater or the like).

The ink circulating system 50 includes, as shown in FIG. 2, a main tank 52 in which an ink is stored, a sub tank 53 for temporarily storing an ink, a supply path 54 having one opening end portion (hereinafter, referred to as a supply source hole) 55 disposed in the main tank 52 and the other opening end portion (hereinafter, referred to as a supply hole) 56 disposed in the sub tank 53, a supply pump 58 installed on a supply path 54 to pump liquid, a circulating path 60 configured to have a printing head 24 and having one opening end portion (hereinafter, referred to as a feeding path hole) 69 and the other opening end portion (hereinafter, referred to as a returning path hole) 73 disposed in the sub tank 53, a circulating pump 76 installed more at a side of the feeding path hole 69 (hereinafter, this portion will be referred to as a feeding path 62) than printing head 24 on the circulating path 60 to pump liquid, an opening/closing valve 78 installed more at a side of the returning path hole 73 (hereinafter, this portion will be referred to as a returning path 64) than the printing head 24 on the circulating path 60 to carry liquid, a pressure adjustment device 80 capable of opening the sub tank 53 to the atmosphere or compressing the sub tank 53, and a height adjustment device 82 capable of adjusting the height of at least one of the feeding path hole 69 and returning path hole 73 of the circulating path 60 in a gravity direction, as illustrated by arrows A and B. In addition, the sub tank 53, or the feeding path hole 69 and returning path hole 73 of the circulating path 60, is disposed at a lower height than the printing head 24 in the gravity direction.

The supply pump 58 is configured as a gear pump, and the supply pump 58 may pump an ink from the main tank 52 toward the sub tank 53 by rotating in a predetermined direction (for example, in a clockwise direction) (hereinafter, referred to as the rotation in a normal rotation direction) and simultaneously may pump an ink from the sub tank 53 toward the main tank 52 by rotating in a direction (for example, in a counterclockwise direction) opposite to the rotating direction (hereinafter, referred to as rotation in a reverse direction).

The circulating pump 76 is configured as a gear pump similar to the supply pump 58, and the circulating pump 76 may pump an ink from the feeding path hole 69 toward the printing head 24 by rotating in a predetermined direction (for example, in a clockwise direction) (hereinafter, referred to as the rotation in the normal rotation direction) and simultaneously may pump an ink from the printing head 24 toward the feeding path hole 69 by rotating in a direction (for example, in a counterclockwise direction) opposite to the rotating direction (hereinafter, referred to as rotation in the reverse direction). In addition, the circulating pump 76 is configured not to close the circulating path 60 when the circulation pump 76 stops operating.

Figure 4:
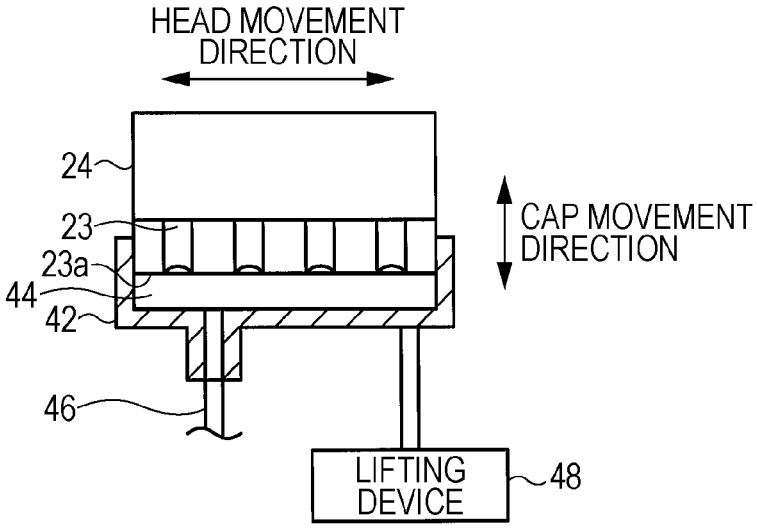
FIG. 4 is a diagram for illustrating that a plurality of nozzles is sealed.

The capping device 40 includes, as shown in FIG. 3, an approximately rectangular cap 42 having an upper opening, an abutment member 44 made of, for example, rubber or the like and disposed in the cap 42 so as to abut onto a surface (hereinafter, referred to as a nozzle forming surface 23*a*) where the plurality of nozzles 23 of the printing head 24 is formed, a discharge path 46 for connecting the bottom portion of the cap 42 to a waste water tank 45, and a lifting device 48 for lifting the cap 42 so as to abut onto the nozzle forming surface 23*a* by the abutment member 44 or release the abutment. The capping device 40 lifts the cap 42 by the lifting device 48 so that the abutment member 44 abuts onto the nozzle forming surface 23*a* when the printing head 24 moves to a location (a so-called home position) on the capping device 40 together with the carriage 22, and the capping device 40 is configured to seal all nozzles 23 (where the plurality of nozzles 23 may be sealed independently). FIG. 4 shows that the capping device 40 seals the plurality of nozzles 23. In addition, in the capping device 40, in the case where the nozzle forming surface 23*a* and the abutment member 44 are spaced apart slightly (several millimeters or the like) so that an ink discharges from the plurality of nozzles 23 in a state where a closed space is formed by the nozzle forming surface 23*a* and the cap 42, the ink discharges to a waste water tank 45 through a gap between the cap 42 and the abutment member 44 or via a discharge path 46.

The controller 90 is configured as a microprocessor based on a CPU 92, as shown in FIG. 1, and includes a ROM 93 where various programs are stored, a RAM 94 for temporarily storing data, an interface (I/F) 95 for exchanging information with exterior devices, and an I/O port not shown. In the RAM 94, a printing buffer region is installed, and printing data sent from a user PC 100 through the I/F 95 is stored in the printing buffer region. In the controller 90, a position detection signal from the linear-type encoder 25, a switch signal from a float switch 59 (see FIG. 2) which turns on when the location (height) of the liquid surface of the ink in the sub tank 53 is equal to or higher than a predetermined location Href and turns off when the location (height) of the liquid surface of the ink in the sub tank 53 is lower than the predetermined location Href, a manipulation signal from the manipulation unit 99 of the manipulation panel 97 or the like are input via an input port, and printing works or the like from the user PC 100 are input via the I/F 95. Here, in this embodiment, the predetermined location Href is set to be a location where a height difference (a differential head) ΔH between the liquid surface of the ink in the sub tank 53 and the nozzle forming surface 23*a* becomes a predetermined value ΔH1, namely a location lower than the nozzle forming surface 23*a* only by the predetermined value ΔH1. The predetermined value ΔH1 is determined to be a predetermined negative pressure (for example, −1 kPa, −0.8 kPa or the like) so that, in the case where the sub tank 53 is exposed to the atmosphere, the pressure applied to the ink in the nozzle 23 may restrain gas penetration into the nozzle 23 from the nozzle forming surface 23*a* and restrains escape of the ink from the nozzle 23, and for example the predetermined location may be 90 mm, 100 mm, 110 mm or the like. In the controller 90, a control signal to the printing head 24, a control signal to the drive motor 33 or the carriage motor 34, a control signal to a lifting device 48 (see FIG. 3) of the capping device 40, a control signal to the supply pump 58, the circulating pump 76, the opening/closing valve 78, or the pressure adjustment device 80 (see FIG. 2), a display control signal to the display unit 98 of the manipulation panel 97 or the like may be output via an output port, and printing status information or the like is output to the user PC 100 via the I/F 95.

In the ink jet printer 20 according to this embodiment configured as above, in the case where ink droplets are discharged from the plurality of nozzles 23 of the printing head 24 to perform printing to the paper P, the height adjustment device 82 is controlled so that the feeding path hole 69 of the circulating path 60 comes to be at a lower location than the returning path hole 73 of the circulating path 60 or the supply hole 56 of the supply path 54 in the gravity direction, and the opening/closing valve 78 is controlled by the supply pump 58 and the circulating pump 76 so that both of the supply pump 58 and the circulating pump 76 rotate in the normal rotation direction in a state where the opening/closing valve 78 is opened. In this way, the ink in the main tank 52 is supplied to the sub tank 53, and the ink in the sub tank 53 is supplied from the feeding path hole 69 to the printing head 24 and simultaneously is partially returned via the printing head 24 from the returning path hole 73 to the sub tank 53. Here, when printing is performed so that the feeding path hole 69 of the circulating path 60 is at a lower location than the returning path hole 73 of the circulating path 60 or the supply hole 56 of the supply path 54, gas (bubbles) is restrained from penetrating from the feeding path hole 69 to the circulating path 60 and reaches the printing head 24. By doing so, the printing process may be performed more suitably. In addition, bubbles generated in the sub tank 53 include bubbles included in the ink pumped via the supply path 54 from the main tank 52 to the sub tank 53, bubbles included in the ink discharging from the returning path hole 73 of the circulating path 60 to the sub tank 53 or the like.

Figure 5:
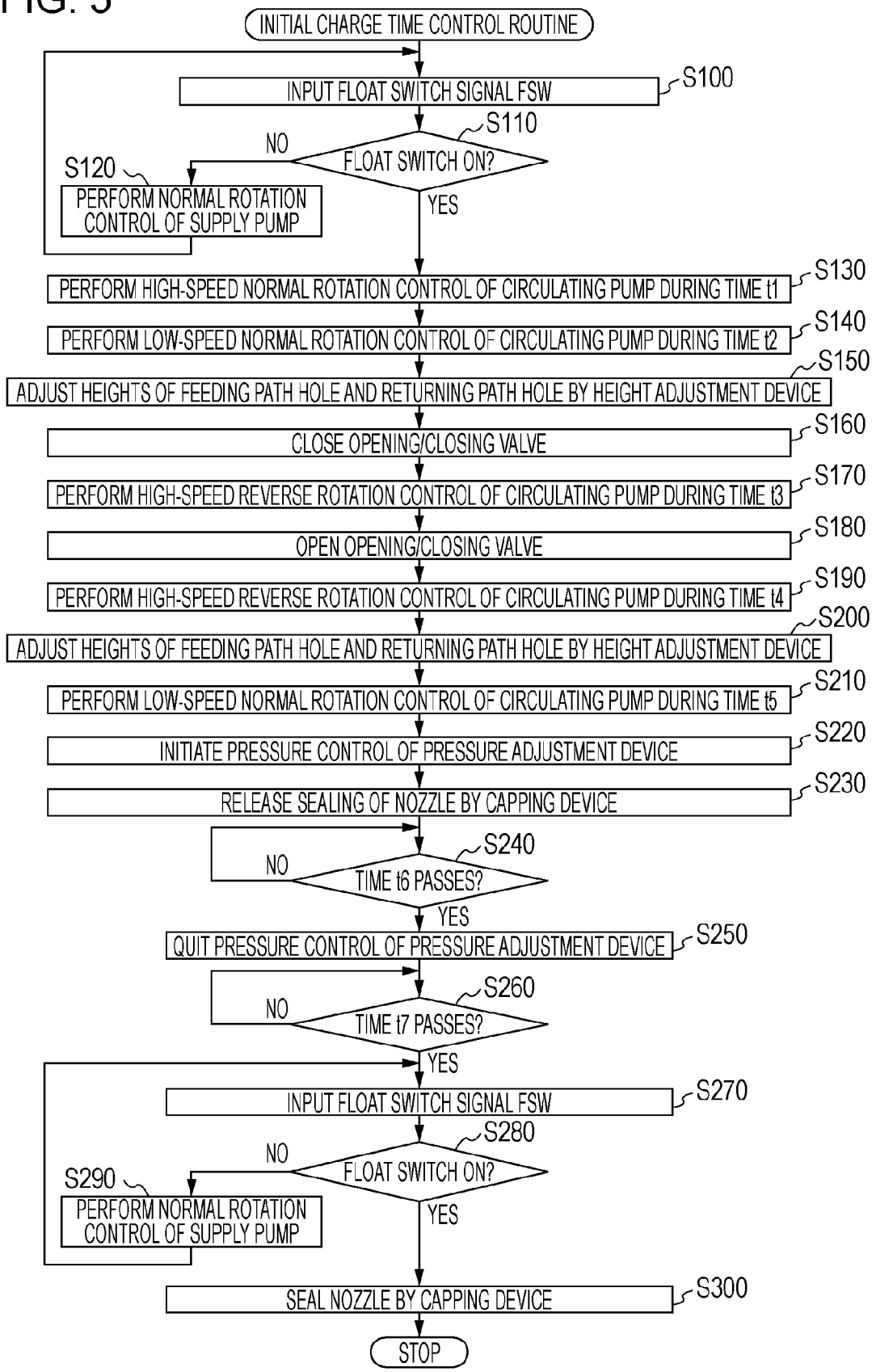
FIG. 5 is a flowchart for illustrating an example of an initial charge time control routine.

Next, operations of the ink jet printer 20 according to this embodiment configured as above, particularly operations at initial charging for charging the printing head 24 with an ink, will be described. FIG. 5 is a flowchart showing one example of an initial charge time control routine executed by the controller 90. This routine is executed when it is instructed to fill an ink in the printing head 24. In addition, when this routine is initiated, in this embodiment, the sub tank 53 is opened to the atmosphere by the pressure adjustment device 80 so that the plurality of nozzles 23 are sealed by the capping device 40 and the opening/closing valve 78 is open, and therefore the feeding path hole 69 of the circulating path 60 is adjusted to be at a lower location than the returning path hole 73 (so that the returning path hole 73 is at a higher location than the feeding path hole 69) by the height adjustment device 82. In addition, in the following description, if the ink circulates along the circulating path 60 from the feeding path hole 69 via the feeding path 62, the printing head 24, and the returning path 64 toward the returning path hole 73 by the drive of the circulating pump 76 in a forward direction, this is called normal circulation, while, if the ink circulates from the returning path hole 73 toward the feeding path hole 69 via the returning path 64, the printing head 24, and the feeding path 62 by the drive of the circulating pump 76 in a reverse direction, this is called reverse circulation.

If the initial charge time control routine is performed, the controller 90 firstly inputs a float switch signal FSW from the float switch 59 (Step S100), and simultaneously examines the input float switch signal FSW (Step S110), and then, if the float switch signal FSW is off, namely if the location (height) of the ink in the sub tank 53 is lower than a predetermined location Href, the supply pump 58 is controlled so that the circulating pump 76 rotates in the normal rotation (so that the ink is pumped from the main tank 52 to the sub tank 53) (Step S120), and the process proceeds to Step S100. Steps S100 to S120 are performed to adjust pressure (negative pressure) applied to the ink in the nozzle 23.

In the case where the float switch signal FSW in Step S110, namely in the case where the location (height) of the liquid surface of the ink in the sub tank 53 is equal to or higher than the predetermined location Href, the high-speed normal rotation control for controlling the circulating pump 76 so that the circulating pump 76 rotates a predetermined rotation number N1, which is determined to be a relatively high revolution number in the normal rotation direction, is executed during a predetermined time t1 (Step S130). Here, the predetermined time t1 is determined as time which is required for the ink equal to or greater than the entire volume of the circulating path 60 to circulate along the circulating path 60 in the forward direction when the high-speed normal rotation control is executed, and it may be set to be, for example, 2 minutes, 3 minutes, 4 minutes or the like. By executing the high-speed normal rotation control, it is possible that the ink circulates along the circulating path 60 in the forward direction. Further, in this embodiment, since the high-speed normal rotation control is executed in a state where the plurality of nozzles 23 are sealed by the capping device 40, it is possible to restrain the ink from discharging (leaking) from the plurality of nozzles 23 when the high-speed normal rotation control is executed. Further, in this embodiment, the high-speed normal rotation control is executed in a state where the feeding path hole 69 of the circulating path 60 is lower than the returning path hole 73, and so it is possible to restrain gas (bubbles) from penetrating from the feeding path hole 69 to the circulating path 60. In addition, in the case where the circulating path 60 has a location (for example, a joint of each part of the circulating path 60 or the like, where the location will be hereinafter referred to as a forward direction stay location) where gas (bubbles) tends to easily stay when the ink circulates along the circulating path 60 in the forward direction, gas may stay at the forward direction stay location when the high-speed normal rotation control is executed.

If the high-speed normal rotation control is executed during the predetermined time t1 as described above, a low-speed normal rotation control for controlling the circulating pump 76 so that the circulating pump 76 rotates at a predetermined rotation number N2, which is determined to be a lower rotation number than the predetermined rotation number N1 in the normal rotation direction, is executed during a predetermined time t2 (Step S140). Here, the predetermined time t2 is determined as time required for stabilizing the rotation of the ink along the circulating path 60 in the forward direction, and it may be set to be, for example, 25 seconds, 30 seconds, 35 seconds or the like.

Next, the height adjustment device 82 is controlled so that the returning path hole 73 of the circulating path 60 is at a location lower than the feeding path hole 69 (so that the feeding path hole 69 is at a higher location than the returning path hole 73) (Step S150), and then the opening/closing valve 78 is closed (Step S160). Then, a high-speed reverse rotation control for controlling the circulating pump 76 so that the circulating pump 76 rotates at a predetermined rotation number N3, which is determined as a relatively high rotation number in the reverse direction is executed during a predetermined time t3 (Step S170), and then the opening/closing valve 78 is opened (Step S180). After that, a high-speed reverse rotation control is executed during a predetermined time t4 (Step S190). Here, the predetermined time t3 is time required for expanding the gas in the circulating path 60, and it may be set to be, for example, 50 seconds, 1 minute, 1 minute and 10 seconds or the like. In addition, the predetermined time t4 is determined as time required for the ink in the entire volume of the circulating path 60 to circulate along the circulating path 60 in the reverse direction when the high-speed reverse rotation control is executed, and it may be identical to the predetermined time t1 or not. First, by executing the high-speed reverse rotation control in a state where the opening/closing valve 78 is closed, the ink more at the feeding path hole 69 (hereinafter, referred to as a predetermined portion) than at the opening/closing valve 78 in the circulating path 60 is pumped toward the feeding path hole 69 so as to deteriorate the pressure at the predetermined portion, and so the ink expands if gas (bubbles) is present in the portion. In addition, after that, by executing the high-speed reverse rotation control in a state where the opening/closing valve 78 is open, the expanding gas is pumped to the feeding path hole 69 and discharges to the sub tank 53. Further, in this case, since the flow rate of the ink increases so as to lower the pressure of the predetermined portion just after the opening/closing valve 78 is opened, the gas may be more easily pumped to the feeding path hole 69. By executing the high-speed reverse rotation control accompanied with the opening/closing of the opening/closing valve 78, it is possible to expand the gas in the circulating path 60 and simultaneously increase the flow rate of the ink so as to more securely discharge to (remove) the sub tank 53. In particular, in the case where the circulating path 60 is shaped to have a forward direction stay location, the gas at the forward direction stay location may not be sufficiently removed if only the gas in the reverse direction is pumped only for a short time during or after circulating the circulating path 60 in the forward direction, but in this embodiment, the ink equal to or greater than the entire volume of the circulating path 60 circulates along the circulating path 60 in the forward direction and then the ink equal to or greater than the entire volume of the circulating path 60 circulates along the circulating path 60 in the reverse direction, and so the ink at the forward direction stay location or the like may be more securely discharged to the sub tank 53. In addition, in this embodiment, since the high-speed reverse rotation control is executed in a state where the plurality of nozzles 23 are sealed by the capping device 40, it is possible to restrain ink from discharging (leaking) from the plurality of nozzles 23 when the high-speed reverse rotation control is executed. Further in this embodiment, by executing the high-speed normal rotation control in a state where the returning path hole 73 of the circulating path 60 is lower than the feeding path hole 69, it is possible to restrain the gas (bubbles) from penetrating from the returning path hole 73 to the circulating path 60.

If the high-speed reverse rotation control is executed during the predetermined time t4 as described above, the height adjustment device 82 is controlled so that the feeding path hole 69 of the circulating path 60 is at a lower location than the returning path hole 73 (Step S200), and so, similar to the process of Step S140, the low-speed normal rotation control is executed during a predetermined time t5 (Step S210). Here, the predetermined time t5 is time required for stabilizing the circulation of the ink along the circulating path 60 in the forward direction, and it may be identical to the predetermined time t2 (for example, 25 seconds, 30 seconds, 35 seconds or the like) or not.

Next, a compressing control for controlling the pressure adjustment device 80 so that the sub tank 53 is compressed by the pressure adjustment device 80 is initiated (Step S220), the capping device 40 is controlled so that the sealing of the plurality of nozzles 23 by the capping device 40 is released (Step S230), and in this state, the passage of a predetermined time t6 is awaited (Step S240). Here, the compressing control is a control for compressing the sub tank 53 so that the pressure applied to the ink in the nozzle 23 becomes a positive pressure (for example, 10 kPa, 12 kPa or the like). In addition, the sealing of the plurality of nozzles 23 is released as the nozzle forming surface 23*a* and the abutment member 44 are spaced slightly (several millimeters or the like) to form a closed space by the nozzle forming surface 23*a* and the cap 42. If the sealing of the plurality of nozzles 23 is released while executing the compressing control, the ink in the sub tank 53 flows to printing head 24, and so, in the case where gas (bubbles) is present in the plurality of nozzles 23, the ink discharges from the plurality of nozzles 23 together with the gas. By doing so, the gas in the plurality of nozzles 23 may be more securely removed. In addition, the ink delivered from the plurality of nozzles 23 discharges via the gap between the cap 42 and the abutment member 44 or via the discharge path 46 to the waste water tank 45. By the processes of Steps S220 to S240, the gas in the plurality of nozzles 23 may be sufficiently discharged. The predetermined time t6 is determined as time required for discharging the gas from the plurality of nozzles 23, and it may be set to be, for example, 3 seconds, 5 seconds, 7 seconds or the like.

If the predetermined time t6 passes as described above, the compressing control is completed in the state where the sub tank 53 is opened to the atmosphere (Step S250), and the passage of a predetermined time t7 is awaited (Step S260). Here, the predetermined time t7 is determined as time required for stabilizing the meniscus of the ink in the plurality of nozzles 23, and it may be set to be, for example, 8 seconds, 10 seconds, 12 seconds or the like.

In addition, the float switch signal FSW from the float switch 59 is input (Step 270), and simultaneously the input float switch signal FSW is examined (Step S280). In the case where the float switch signal FSW is off, the supply pump 58 is controlled so that the circulating pump 76 rotates in the normal rotation (so that the ink is pumped from the main tank 52 to the sub tank 53) (Step S290), and the process returns to Step S270. Meanwhile, if the float switch signal FSW is on in Step S280, the capping device 40 is controlled so that the plurality of nozzles 23 are sealed by the capping device 40 (Step S300), and this routine is completed.

Here, correspondence relationships between the components of this embodiment and the component of the present invention are clearly defined. The printing head 24 of this embodiment corresponds to the "discharging head", the sub tank 53 corresponds to the "storing unit", the circulating path 60 corresponds to the "circulating path", the circulating pump 76 corresponds to the "pump unit", and the controller 90 for executing the initial charge time control routine of FIG. 5 corresponds to the "charge time control unit". In addition, in this embodiment, the operations of the liquid discharging apparatus are described to clearly show an example of the method for controlling the liquid discharging apparatus according to the present invention.

If the ink jet printer 20 according to this embodiment described as above is used, when the printing head 24 is charged with an ink, the circulating pump 76 is controlled so that the ink equal to or greater than the entire volume of the circulating path 60 circulates from the feeding path hole 69 to the returning path hole 73 via the printing head 24 (in the forward direction), and then the circulating pump 76 is controlled so that the ink equal to or greater than the entire volume of the circulating path 60 circulates from the returning path hole 73 to the feeding path hole 69 via the printing head 24 (in the reverse direction), so gas (bubbles) in the circulating path 60 may be more securely discharged to the sub tank 53.

In addition, if the ink jet printer 20 according to this embodiment is used, when the printing head 24 is charged with an ink, the ink circulates along the circulating path 60 in the forward direction, then the circulating pump 76 is controlled in a state where the opening/closing valve 78 is closed so that the ink is pumped along the circulating path 60 in the reverse direction, and then the circulating pump 76 is controlled in a state where the opening/closing valve 78 is opened so that the ink rotates along the circulating path 60 in the reverse direction, so it is possible to expand the gas in the circulating path 60 and simultaneously increase the flow rate of the ink so that the gas may be easily discharged to the sub tank 53.

Further, if the ink jet printer 20 according to this embodiment is used, when the printing head 24 is charged with an ink, the circulating pump 76 is controlled in a state where the feeding path hole 69 of the circulating path 60 is lower than the returning path hole 73 by the height adjustment device 82 so that the ink circulates along the circulating path 60 in the forward direction, and the circulating pump 76 is controlled in a state where the returning path hole 73 of the circulating path 60 is lower than the feeding path hole 69 by the height adjustment device 82 so that the ink rotates along the circulating path 60 in the reverse direction, so it is possible to restrain gas (bubbles) from penetrating from the sub tank 53 to the circulating path 60.

Moreover, if the ink jet printer 20 according to this embodiment is used, since the high-speed normal rotation control or high-speed reverse rotation control is executed in a state where the plurality of nozzles 23 are sealed by the capping device 40, it is possible to restrain the ink from discharging (leaking) from the plurality of nozzles 23 during the above control.

In addition, it is apparent that the present invention may be implemented in various ways within the scope of the invention, without being limited to the above embodiment.

Even though the operations of the initial charging process for charging the printing head 24 with an ink have been described in the above embodiment, the same operations may be performed even when the printing head 24 is cleaned. In this case, for example, the predetermined time t1 or predetermined time t4 may be set to be 50 seconds, 1 minute, 1 minute and 10 seconds or the like, the predetermined time t2 or predetermined time t5 may be set to be 8 seconds, 10 seconds, 12 seconds or the like, the predetermined time t3 may be set to be 25 seconds, 30 seconds, 35 seconds or the like, the predetermined time t6 may be set to be 3 seconds, 5 seconds, 7 seconds or the like, and the predetermined time t7 may be set to be 8 seconds, 10 seconds, 12 seconds or the like. In addition, the timing for cleaning the printing head 24 may be considered as when the main tank 52 or sub tank 53 is exchanged, when the cleaning work is indicated by manipulating the manipulation unit 99 or the like.

Even though the high-speed normal rotation control or high-speed reverse rotation control is executed in the above embodiment in a state where the plurality of nozzles 23 are sealed by the capping device 40, the high-speed normal rotation control or high-speed reverse rotation control may also be executed without sealing the plurality of nozzles 23.

Even though the low-speed normal rotation control is executed during the predetermined time t2 after the high-speed normal rotation control is executed during the predetermined time t1 in the above embodiment, the low-speed normal rotation control may not be executed.

In the above embodiment, the circulating pump 76 is controlled in a state where the feeding path hole 69 of the circulating path 60 is lower than the returning path hole 73 by the height adjustment device 82 so that the ink circulates along the circulating path 60, and simultaneously the circulating pump 76 is controlled in a state where the returning path hole 73 of the circulating path 60 is lower than the feeding path hole 69 by the height adjustment device 82 so that ink circulates along the circulating path 60 in the reverse direction. However, regardless of the fact whether the ink circulates along the circulating path 60 in the forward direction or in the reverse direction, the feeding path hole 69 of the circulating path 60 and the returning path hole 73 may be approximately at the same height. In this case, even though the location relationship between the feeding path hole 69 and the returning path hole 73 is not adjusted, it is possible that gas may penetrate from the sub tank 53 to the circulating path 60 to some extent regardless of the flowing direction of the ink. In addition, in this case, the height adjustment device 82 may not be equipped.

In the above embodiment, before the high-speed reverse rotation control is executed during the predetermined time t4 in a state where the opening/closing valve 78 is opened, the high-speed reverse rotation control is executed during the predetermined time t3 in a state where the opening/closing valve 78 is closed. However, the high-speed reverse rotation control may not be executed during the predetermined time t3 in a state where the opening/closing valve 78 closed.

Figure 6:
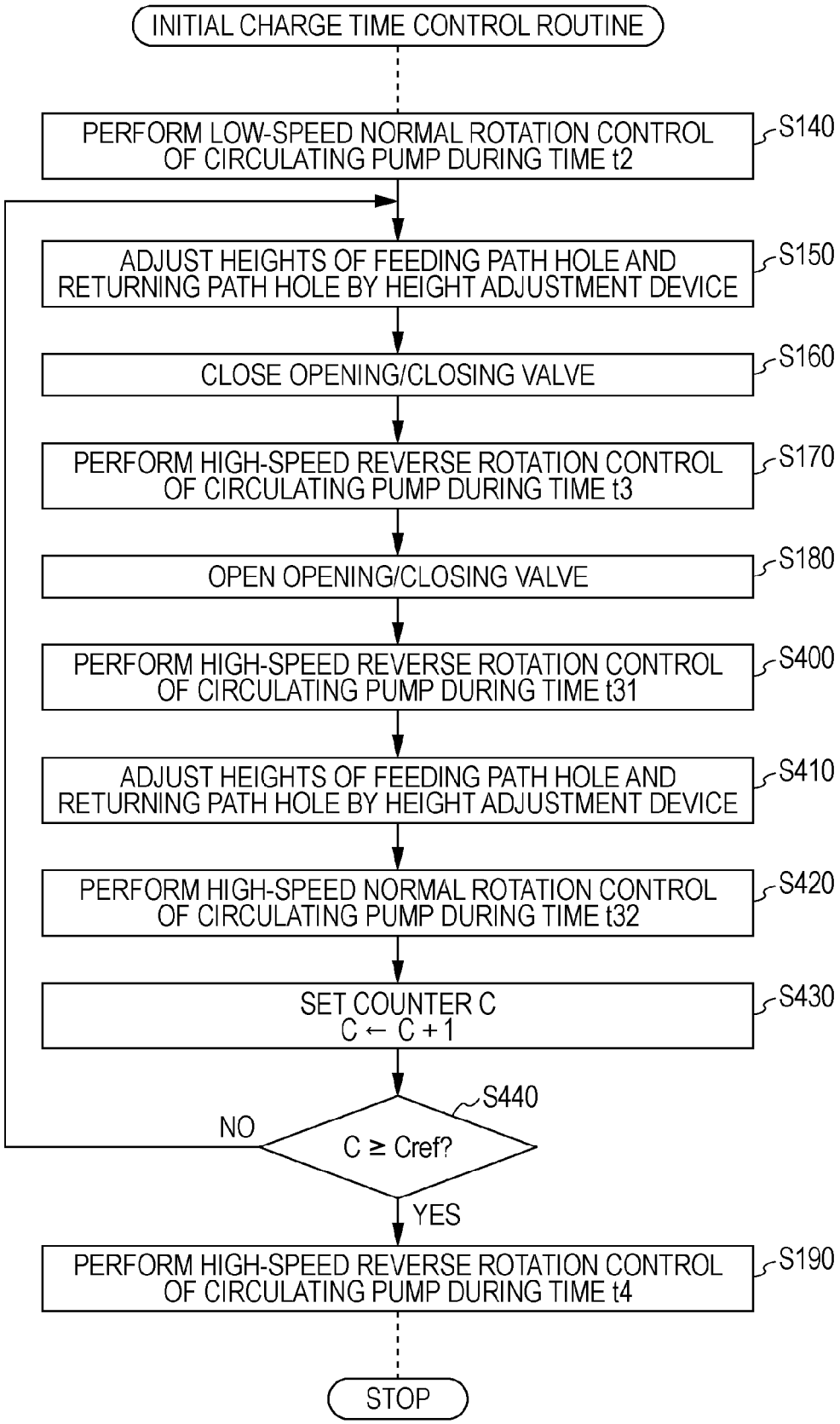
FIG. 6 is a flowchart for illustrating an example of an initial charge time control routine.

In the above embodiment, before the high-speed reverse rotation control is executed during the predetermined time t4 in a state where the opening/closing valve 78 is opened, the high-speed reverse rotation control is executed during the predetermined time t3 in a state where the opening/closing valve 78 is closed. FIG. 6 shows a part of one example of the initial charge time control routine of this case. This routine is identical to the initial charge time control routine of FIG. 5, except that the processes of Steps S400 to S440 are added between the process of Step S180 and the process of Step S190 so that the process of Step S440 may return to Step S150. In this routine, if the low-speed normal rotation control is executed during the predetermined time t2 (Step S140), the returning path hole 73 of the circulating path 60 is at a lower location than the feeding path hole 69 by the height adjustment device 82 to close all opening/closing valves 78, and the high-speed reverse rotation control is executed during the predetermined time t3 (Steps S150 to S170). After that, the opening/closing valve 78 is opened, and the high-speed reverse rotation control is executed during the predetermined time t31 (Steps S400 and S410). Then, the high-speed normal rotation control is executed during the predetermined time t32 while the feeding path hole 69 of the circulating path 60 is at a lower location than the returning path hole 73 by the height adjustment device 82 (Steps S420 and S430), and an increment is applied to a counter C, which is set to be 0 as an initial value, and the counter C is compared with a minimal physical quantity Cref (for example, 1, 2, 3 or the like) which causes reaction (Steps S440 and S450). If the counter C is less than the reaction-causing minimal physical quantity Cref, the process returns to Step S150, while, if the counter C is equal to or greater than the reaction-causing minimal physical quantity Cref, the processes after Step S190 are performed. Here, the predetermined time t31 or predetermined time t32 is time for moving gas (bubbles) in the circulating path 60 in the reverse direction or in the forward direction, and it may be shorter than the predetermined time t4, for example 25 seconds, 30 seconds, 35 seconds or the like. In this routine, gas (bubbles) in the circulating path 60 is expanded by executing the high-speed reverse rotation control during the predetermined time t3 in a state where the opening/closing valve 78 is closed, and after that, the gas is moved in the circulating path 60 in the reverse direction or in the forward direction by executing the high-speed reverse rotation control during the predetermined time t31 or by executing the high-speed normal rotation control during the predetermined time t32 in a state where the opening/closing valve 78 is opened. By doing so, the gas in the circulating path 60 may be easily removed. In this modification, before the high-speed reverse rotation control is executed during the predetermined time t4 in a state where the opening/closing valve 78 is opened, another process is executed in addition to the high-speed reverse rotation control during the predetermined time t3 in a state where the opening/closing valve 78 is closed, but it is also possible that another process is executed instead of the high-speed reverse rotation control during the predetermined time t3 in a state where the opening/closing valve 78 is closed. In this case, the processes of Steps S160 to S180 in the initial charge time control routine of FIG. 6 may not be executed. In other words, after the high-speed normal rotation control or the low-speed normal rotation control is executed, the high-speed reverse rotation control may be executed during the predetermined time t31 and simultaneously the high-speed normal rotation control may be executed during the predetermined time t32. At this time, in the case where the counter C is equal to or greater than the reaction-causing minimal physical quantity Cref, the high-speed reverse rotation control may be executed during the predetermined time t4. Even in this case, by executing the high-speed reverse rotation control during the predetermined time t31 or executing the high-speed normal rotation control during the predetermined time t32, the gas may be moved in the circulating path 60 in the reverse direction or in the forward direction so that the gas in the circulating path 60 may be more easily removed.

In the above embodiment, after the high-speed reverse rotation control is executed during the predetermined time t4, the low-speed normal rotation control is executed during the predetermined time t5. However, the low-speed normal rotation control may not be executed.

In this embodiment, after the high-speed normal rotation control, the high-speed reverse rotation control or the like is executed, the sealing of the plurality of nozzles 23 by the capping device 40 is released while compressing the sub tank 53 by the pressure adjustment device 80. However, after executing the high-speed normal rotation control, the high-speed reverse rotation control or the like, the sealing of the plurality of nozzles 23 by the capping device 40 may be released while an ink circulates along the circulating path 60 by rotating the circulating pump 76. In addition, after executing the high-speed normal rotation control, the high-speed reverse rotation control or the like, the sealing of the plurality of nozzles 23 by the capping device 40 may not be released.

In the above embodiment, after the compressing control is completed, that the passage of the predetermined time t7 is awaited, and then the supply pump 58 is controlled as necessary. However, after the compressing control is completed, the supply pump 58 may be controlled as necessary without waiting for the passage of the predetermined time t7.

In the above embodiment, after the compressing control is completed, the ink is pumped from the main tank 52 to the sub tank 53 as necessary. However, after the compressing control is completed, the ink may not be pumped from the main tank 52 to the sub tank 53.

In the above embodiment, the supply pump 58 uses a gear pump, but it may also use a tube pump or the like. The circulating pump 76 may also use a tube pump or the like.

In the above embodiment, the ink circulating system 50 includes the main tank 52, the sub tank 53, the supply path 54, the supply pump 58, the circulating path 60, the circulating pump 76, the opening/closing valve 78, the pressure adjustment device 80, and the height adjustment device 82. However, the main tank 52, the supply path 54, or the supply pump 58 may not be included.

In the above embodiment, the ink jet printer 20 having a single printing head 24 has been described, but it may also be applied to an ink jet printer having a plurality of printing heads.

In the above embodiment, the example where the liquid discharging apparatus of the present invention is implemented as the ink jet printer 20 is described. However, the present invention may also be implemented as a liquid discharging apparatus for discharging fluid-state materials such as a liquid-state material (a dispersion solution) and a gel where a liquid other than the ink or particles of functional materials are dispersed. For example, it may be a liquid discharging apparatus for discharging a liquid where electrode materials, colorants or the like used for manufacturing a liquid crystal display, an EL (Electroluminescence) display and a surface emitting display are dissolved, a liquid discharging apparatus for discharging a liquid-state material where the same material is dispersed, or a liquid discharging apparatus for discharging a liquid which is used by a precise pipette to be a specimen. In addition, it may be a liquid discharging apparatus for discharging a lubricant by a pin point to a precise machine such as a clock or camera, a liquid discharging apparatus for discharging a transparent resin solution of a UV-curing resin or the like onto a substrate to form a fine hemispheric lens (optical lens) or the like used for an optical communication element or the like, a liquid discharging apparatus for discharging an etching solution such as acid or alkali to etch a substrate or the like, or a fluid-state material discharging apparatus for discharging a gel.

In the above embodiment, the liquid discharging apparatus of the present invention has been described as being applied to the ink jet printer 20, but it may be a liquid discharging apparatus having a discharging head with nozzles for discharging a liquid, and for example, it may be applied to another OA device such as a facsimile device, a multi-function printer or the like, without being limited to the above.

The entire disclosure of Japanese Patent Application No. 2011-47524, filed Mar. 4, 2011 is expressly incorporated by reference herein.

What is claimed is:

1. A liquid discharging apparatus having a discharging head with a plurality of nozzles for discharging a liquid, the apparatus comprising:

a storing unit for storing a liquid;

a circulating path configured to include the discharging head, the circulation path having one opening end portion and another opening end portion, each of which is disposed in the storing unit;

a pump unit installed at the one opening end portion side rather than the discharging head side in the circulating path and configured to pump a liquid so that the liquid circulates along the circulating path; and a control unit for executing a first circulation control which controls the pump unit to circulate the liquid from the one opening end portion side to the another opening end portion side via the discharging head by the drive of the pump unit when the discharging head is filled with the liquid, and for executing a third circulation control a plurality number of times after the first circulation control is executed, and for executing a second circulation control which controls the pump unit to circulate the liquid from the another opening end portion side to the one opening end portion side via the discharging head by the drive of the pump unit after the plurality number of times of third circulation control is executed, wherein the third circulation control includes a short-time first control for controlling the pump unit to pump the liquid from the another opening end portion side to the one opening end portion side by the drive of the pump unit during a shorter time than an execution time of the second circulation control, and a short-time second control for controlling the pump unit to pump the liquid from the one opening end portion side to the another opening end portion side by the drive of the pump unit during a shorter time than the execution time of the second circulation control after the short-time first control is executed.

2. The liquid discharging apparatus according to claim 1, further comprising:

an opening/closing valve installed at the another opening end portion side rather than the discharging head in the circulating path so as to be capable of opening/closing, wherein the control unit executes the first circulation control in a state where the opening/closing valve is open, then controls the opening/closing valve so that the opening/closing valve is closed, controls the pump unit so that a predetermined liquid which is at the one opening end portion side rather than the opening/closing valve in the circulating path is pumped to the one opening end portion side by the drive of the pump unit, controls the opening/closing valve so that the opening/closing valve is opened, and then executes the second circulation control.

3. The liquid discharging apparatus according to claim 2, wherein, after the first circulation control is executed and the one opening/closing valve is opened, the control unit executes the third circulation control.

4. The liquid discharging apparatus according to claim 1, further comprising:

a height adjustment unit capable of adjusting the height of at least one of the one opening end portion and the another opening end portion in the circulating path in a gravity direction, wherein, the control unit controls the height adjustment unit so that the one opening end portion is lower than the another opening end portion when the liquid circulates from the one opening end portion side to the another opening end portion side, and the control unit controls the height adjustment unit so that the another opening end portion is lower than the one opening end portion when the liquid circulates from the another opening end portion side to the one opening end portion side.

5. The liquid discharging apparatus according to claim 1, wherein the circulating path is formed so that the one opening end portion and the another opening end portion have the same height in a gravity direction.

6. The liquid discharging apparatus according to claim 1, further comprising:

a sealing unit capable of sealing each of the plurality of nozzles independently, wherein the control unit executes at least the first circulation control and the second circulation control in a state where the plurality of nozzles are respectively sealed by the sealing unit independently.

7. A control method of a liquid discharging apparatus, which includes a discharging head having a plurality of nozzles for discharging a liquid, a storing unit for storing the liquid, a circulating path configured to include the discharging head, the circulation path having one opening end portion and another opening end portion, each of which is disposed in the storing unit, and a pump unit installed at the one opening end portion side rather than the discharging head in the circulating path and configured to pump a liquid so that the liquid circulates along the circulating path, the method comprising:

executing a first circulation control which controls the pump unit to circulate the liquid from the one opening end portion side to the another opening end portion side via the discharging head by the drive of the pump unit when the discharging head is filled with the liquid;

executing a third circulation control a plurality number of times after the first circulation control is executed;

after the first circulation control is executed, executing a second circulation control which controls the pump unit to circulate the liquid from the another opening end portion side to the one opening end portion side via the discharging head by the drive of the pump unit after the plurality number of times of third circulation control is executed; and wherein the third circulation control includes a short-time first control for controlling the pump unit to pump the liquid from the another opening end portion side to the one opening end portion side by the drive of the pump unit during a shorter time than an execution time of the second circulation control, and a short-time second control for controlling the pump unit to pump the liquid from the one opening end portion side to the another opening end portion side by the drive of the pump unit during a shorter time than the execution time of the second circulation control after the short-time first control is executed.

* * * * *